US005249719A

United States Patent [19]

Hulyk

[11] Patent Number: 5,249,719

[45] Date of Patent: Oct. 5, 1993

[54] ADJUSTABLE CLAMPING GARMENT HANGER

[76] Inventor: Myron Hulyk, 20037 Edmunton, St. Clair Shores, Mich. 48080

[21] Appl. No.: 47,785

[22] Filed: Apr. 15, 1993

Related U.S. Application Data

[63] Continuation-in-part of Ser. No. 929,583, Aug. 17, 1992, abandoned.

[51] Int. Cl.[5] ..... A47G 25/48

[52] U.S. Cl. ..... 223/96; 223/95

[58] Field of Search ..... 223/96, 95, 85, 91; 211/113; D6/315, 326

[56] References Cited

U.S. PATENT DOCUMENTS

| | | | |
|---|---|---|---|
| 1,018,056 | 2/1912 | Hincher | 223/96 |
| 1,579,349 | 4/1926 | Criss | 223/96 |
| 1,955,792 | 4/1934 | Deknatel | 223/96 |
| 2,119,934 | 6/1938 | Woods | 223/96 |
| 2,421,051 | 5/1947 | Brinkman | 223/96 |
| 2,565,414 | 8/1951 | Warren | 223/96 |
| 2,588,965 | 3/1952 | Crockett, Jr. | 223/96 |
| 2,607,517 | 8/1952 | Crockett, Jr. | 223/96 |
| 3,048,312 | 8/1962 | Birnbaum | 223/96 |
| 3,593,897 | 7/1971 | Knox | 223/96 |
| 3,972,455 | 8/1976 | Collins | 223/96 |
| 3,984,037 | 10/1976 | Peterson | 223/96 |

FOREIGN PATENT DOCUMENTS

| | | | |
|---|---|---|---|
| 384036 | 10/1923 | Fed. Rep. of Germany | 223/96 |
| 531896 | 7/1940 | United Kingdom | 223/96 |

*Primary Examiner*—Clifford D. Crowder
*Assistant Examiner*—Bibhu Mohanty
*Attorney, Agent, or Firm*—Peter D. Keefe

[57] ABSTRACT

A clamping garment hanger according to the present invention is composed of first and second jaws pivotally mounted via first and second leg members; a lever mechanism for providing a primary clamping system for the jaws; and a secondary clamping system which includes a fork connected with the lever mechanism wherein the fork includes a yoke, a collar which freely and floatingly encompasses the first and second leg members, wherein the collar includes a tongue and a foot carrying a roller, and a scuff bar connected with the first jaw. In operation, when quite thick garments are to be hung, the lever mechanism clamps and locks the first and second jaws together, while the collar floats into an abutting position with respect to the second leg member while the tongue thereof is received alignably by the yoke and the roller carried on the foot abuts the scuff bar. The collar interacts with the first and second leg members so as to guidably prevent them from being oversprung and thereby serving in this case, with the fork and scuff bar, as the secondary clamping system. When even thicker garments are to be hung, the roller carried on the foot will move into a position in which it abuts the rear side of the yoke, thereby supplying a locking interaction with the first and second leg members so as to guidably prevent them from being oversprung and thereby serving in this case, with the fork, as the secondary clamping system.

9 Claims, 2 Drawing Sheets

ADJUSTABLE CLAMPING GARMENT HANGER

CROSS-REFERENCE TO RELATED APPLICATIONS

The present application is a Continuation-in-Part of application Ser. No. 07/929,583, filed on Aug. 17, 1992, which is now abandoned.

BACKGROUND OF THE INVENTION

1. Field of the invention

The present invention is related to clamping garment hangers of the class utilizing two hangably interconnected jaws which are mutually clampably locked by operation of a lever, and more particularly to a garment hanger of the aforesaid class which is further provided with a secondary clamping system for accommodating a wide range of garment thicknesses between the two jaws without danger of the garment hanger being damaged by being oversprung.

2. Description of the Prior Art

Clamping garment hangers are well known in the prior art, such as represented by U.S. Pat. No. 1,955,792 to Deknatel, dated Apr. 24, 1934. Such clamping garment hangers are composed of two opposing jaws which are mutually hinged and which are mutually clamped together so as to hold garments therebetween by operation of a lever mechanism connected with the hanger and a pair of leg members, each leg member being, in turn, connected with a respective jaw.

Clampable garment hangers clamp adequately well with respect to garments placed between the jaws when they are new, but over time, the leg members tend to became oversprung, thereby deleteriously reducing the clamping force between the jaws. This oversprung condition is accelerated when the garments placed between the jaws is quite thick, such as would happen when a user places two, three or four pairs of pants between the jaws.

Also, even though a rotating bearing may be connected with the lever mechanism, as is described in U.S. Pat. No. 1,955,792, there is still deteriorative erosion at the lever engagement point, seriously reducing the clamping force and rendering locking in the clamped state unreliable, in either case making garment holding less effective or impossible.

Accordingly, what is needed is a clamping garment hanger which is able to accommodate thick garments without being oversprung and which is insensitive to erosion over long-term usage.

SUMMARY OF THE INVENTION

The present invention is a clamping garment hanger which is able to accommodate thick garments without being oversprung and which is not sensitive to erosion over long-term usage.

The clamping garment hanger according to the present invention is composed generally of front and rear jaws which are mutually pivotally connected via first and second leg members; a lever mechanism for providing a primary clamping system of the two jaws mutually together; and a secondary clamping system which includes a fork connected with the lever mechanism wherein the fork includes a yoke, a collar which freely and floatingly encompasses the first and second leg members wherein the collar includes a tongue and a foot carrying a roller, and a scuff bar connected with the front jaw.

In operation with respect to a standard thickness of garments to be hung, which is defined herein to mean a single pair of regular pants, the lever mechanism provides a primary clamping system for clampably locking the front jaw with respect to the rear jaw by operation of the lever mechanism, wherein a J-shaped lever pivotally rotates on the first leg member into locked engagement with a rotating bearing on the second leg member. The secondary clamping system is not now operative in a substantive way to assist the first clamping system to provide the mutually clamped relationship of first and second jaws.

In operation with respect to a standard thickness of garments, which is defined herein to mean two or more pairs of regular pants or one or more pairs of bulky pants, the secondary clamping system is now operative in addition to the primary raping system. In this regard, the collar floats into an abutting position with respect to the second leg member while the tongue thereof is received alignably by the yoke and the roller carried on the foot abuts the scuff bar. The collar interacts with the first and second leg members so as to guidably prevent them from being oversprung and thereby serving, with the fork and scuff bar, as the secondary clamping system.

In operation with respect to an extraordinary thickness of garments, which is defined herein to mean a number of pairs of standard pants or one or more pairs of extremely bulky pants such as down filled snow suit pants, the primary clamping system is now functioning to provide clamping force to, but not its aforementioned locking of, the first and second jaws; now locking of the first and second jaws in a mutually clamped relationship is provided by the secondary clamping system. In this regard, while the yoke and collar no longer contact one another when the first and second jaws are clamped together via operation of the lever mechanism, the roller carried on the foot will move into a locking position in which it abuts the rear side of the yoke, thereby supplying an interaction with the first and second leg members so as to guidably prevent them from being oversprung and thereby serving, with the fork, as the secondary clamping system.

The first and secondary clamping systems combine to provide automatically adjustable clamping in accommodation of whatever the aforesaid thickness of garments, without suffering from being oversprung.

Further, it is preferred to include a sleeve on the lever so that its interaction with the rotating bearing is otherwise more forceful and less subject to erosion.

Accordingly, it is an object of the present invention to provide a clamping garment hanger which is provided with both a primary and a secondary clamping system for accommodating a wide range of garment thicknesses and for making the garment holder insensitive to becoming oversprung.

It is another object of the present invention to provide a clamping garment hanger which is provided with a primary clamping system in the form of a lever mechanism and is further provided with a secondary clamping system in the form of an interacting fork and collar arrangement.

It is yet a further object of the present invention to provide a clamping garment hanger which is provided with a collar which regulates the relative maximum pivoting of the jaws.

It is still another object of the present invention to provide a clamping garment hanger which is provided with components which are aligned and structured so as to accommodate a wide range of garment thickness, avoid becoming oversprung during operation and minimize erosion over long term usage.

These, and additional objects, advantages, features and benefits of the present invention will become apparent from the following specification.

DETAILED DESCRIPTION OF THE PREFERRED EMBODIMENT

Figure 1:
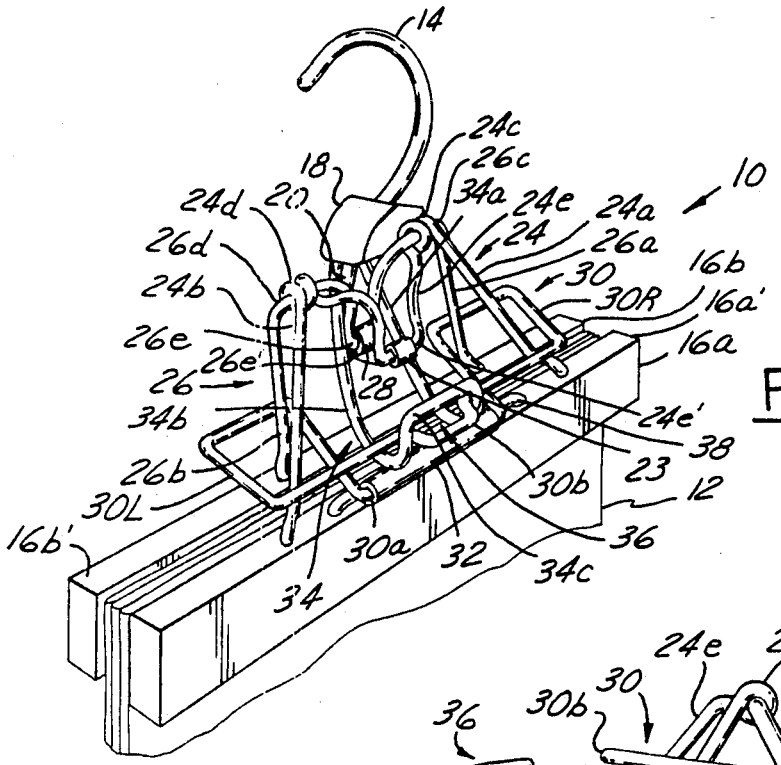
FIG. 1 is a perspective view of the clamping garment hanger according to the present invention, shown in operation with respect to a standard thickness of garments.

Referring now to the Drawing, FIG. 1 shows the clamping garment holder 10 according to the present invention in operation holding a standard thickness of garments 12. It will be discerned that the clamping garment holder 10 includes a hanger 14 for connection in a conventional manner to a hook, rod or other support member (not shown), and that the hanger is connected to a first jaw 16*a* and a second jaw 16*b*, wherein the first and second jaws serve to clamp the garment 12 so that, ultimately, the garment is supported by the hanger 14.

Referring now additionally to FIGS. 2, 3, 4 and 7, the structure of the clamping garment hanger 10 will be detailed.

A connector 18 is attached to the hanger 14. Also attached to the connector 18 is a J-shaped lever 20. Preferably, the hanger 14 and the lever 20 are integral and formed of a single piece heavy gauge wire. Preferably also, a shank portion 20*a* of the lever 20 is sheathed by a wear sleeve 22 (see FIG. 2). A curved portion 20*b* of the lever 20 terminates in a loop 23.

The first and second jaws 16*a*, 16*b* are conventional in structure and dimension, being preferably elongate and rectangular in shape and constructed of wood. A first leg member 24 is attached to the first jaw 16*a*, and a second leg member 26 is attached to the second jaw 16*b*. The first and second leg members 24, 26 provide a supporting connection between the hanger 14 and the first and second jaws 16*a*, 16*b*.

The first leg member 24 is preferably formed of a heavy gauge wire and is composed of two spaced apart first legs 24*a*, 24*b* which terminate anchorably in the upper edge 16*a*, of the first jaw 16*a*. Each first leg 24*a*, 24*b* is provided, respectively, with a helix 24*c*, 24*d*, and the first legs mutually interconnect integrally via a first U-shaped section 24*e*. The first U-shaped section 24*e* is oriented substantially toward the first jaw 16*a* and extends more-or-less a third of the way thereto. Preferably, each of the first legs 24*a*, 24*b* angle gently toward each other from the upper edge 16*a*' to the helices 24*c*, 24*d*.

The second leg member 26 is preferably formed of heavy gauge wire and is composed of two spaced apart second legs 26*a*, 26*b* which terminate anchorably in the upper edge 16*b*', of the second jaw 16*b*. Each second leg 26*a*, 26*b* terminates in a straight segment 26*c*, 26*d* that is substantially parallel with the upper edge 16*b*' and the second legs are mutually interconnected integrally via a second U-shaped section 26*e* located between the straight segments. The second U-shaped section 26*e* is oriented substantially toward the second jaw 16*b* and extends more-or-less a third of the way thereto. Preferably, each of the second legs 26*a*, 26*b* are substantially perpendicularly oriented with respect to the upper edge 16*b*' for a guidance purpose to be elucidated hereinbelow. As can be seen from FIG. 7, the second U-shaped section 26*e* is provided with outwardly bent portions 26*f*, 26*g* adjacent the base thereof 26*e*' for the purpose of providing lockage, as will become clear hereinbelow.

The first leg member 24 is pivotally connected with the second leg member 26 via the straight segments 26*c*, 26*d* of the second leg segment being received, respectively, by the hences 24*c*, 24*d* of the first leg member. Accordingly, the hences 24*c*, 24*d* of the first leg member 24 establish a pivot axis for the straight segments 26*c*, 26*d* of the second leg member 26, which is, in turn, the pivot axis for the first and second jaws 16*a*, 16*b*.

The loop 23 at the distal end of the curved portion 20*b* of the lever 20 encircles the base of the first U-shaped section 24*e* of the first leg member 24. The base of the second U-shaped section 26*e* is provided with a rotating bearing 28.

Figure 3:
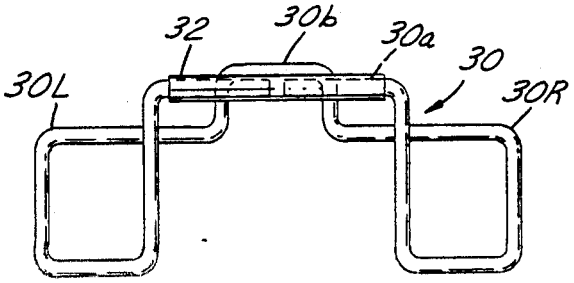
FIG. 3 is a bottom plan view of the collar utilized in the clamping garment holder according to the present invention.
Figure 4:
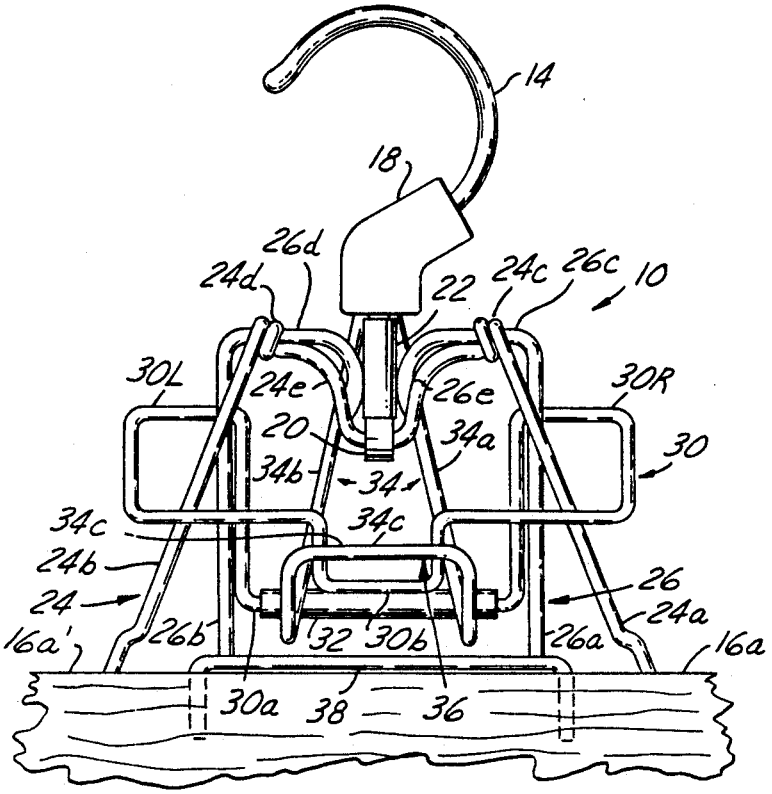
FIG. 4 is a front side view of the garment holder according to the present invention.

As depicted in FIG. 3, a collar 30 is provided, constructed preferably of heavy gauge wire. The collar 30 is shaped so as to provide a left loop 30L and a right loop 30R. The left and right loops 30L, 30R are preferred to be of a generally rectangular shape for purposes of guidable abutment with respect the leg members 24, 26 during operation, as outlined hereinbelow. The left and right loops 30L, 30R are separated by 1) a foot 30*a* which is preferably provided with a roller 32, and 2) by a projecting U-shaped tongue 30*b*. The tongue 30*b* is spaced vertically from the foot 30*a*. The collar 30 is located on the clamping garment hanger 10 so that the first and second legs of the first and second leg members 24, 26 that are located, respectively, on each side of the fist and second jaws 16*a*, 16*b*, are positioned inside respective loops 30L, 30R. That is, first leg 24*a* and second leg 26*a* are located in the right loop 30R, while first leg 24*b* and second leg 26*b* are located in the left loop 30L, wherein the tongue 30*b* is located substantially above the first jaw 16*a* with the foot 30*a* being located nearer thereto. In this regard, the second legs 26*a*, 26*b* are preferably perpendicular with respect to the upper edge 16*b*' so as to be guidably adjacent their respective loop 30L, 30R.

A fork 34 is connected with the connector 18. The fork 34 is preferably constructed of a single piece of heavy gauge wire, having at each near end a loop 34*d*

Figure 5:
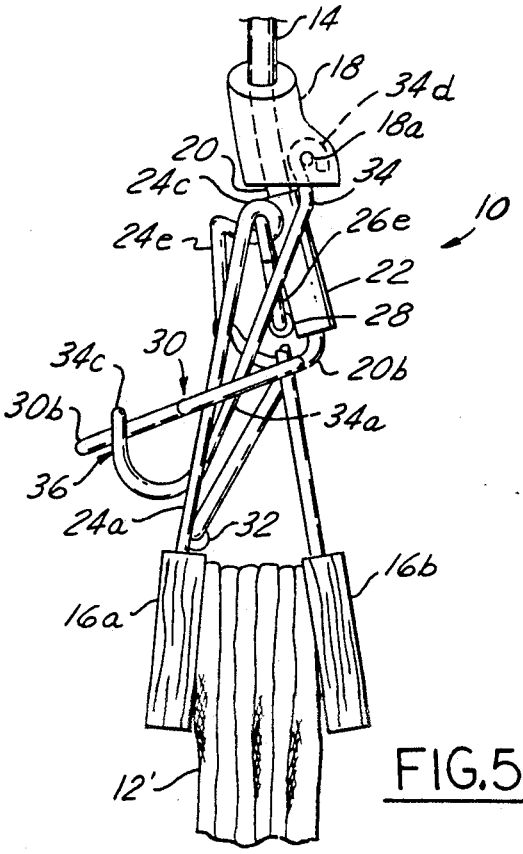
FIG. 5 is a partly broken away end view of the clamping garment holder according to the present invention, shown in operation with respect to a nonstandard thickness of garments.
Figure 6:
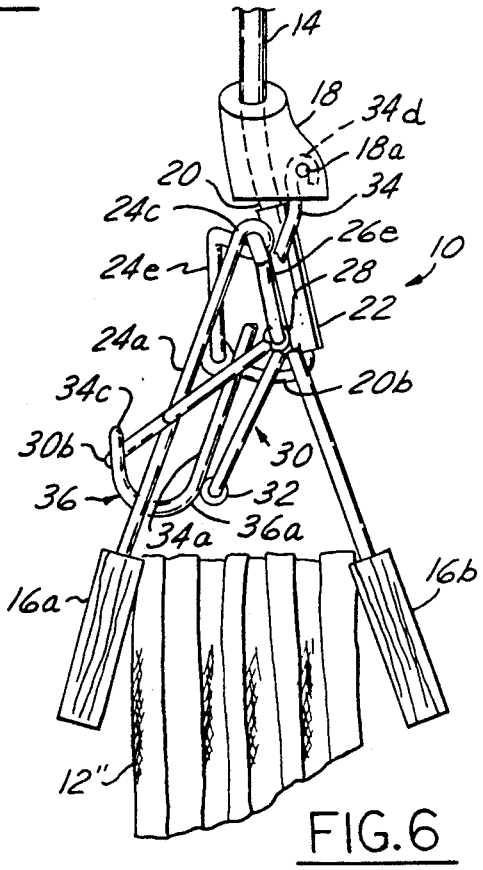
FIG. 6 is a partly broken away end view of the clamping garment holder according to the present invention, shown in operation with respect to an extraordinary thickness of garments.

(see FIGS. 5 and 6). The loops 34*d* are provided for pivotal connection of the fork 34 to the connector 18 via a pivot pin 18*a*. Preferably also, the fork 34 is connected to the connector in an off-set relation to the lever 20 (see FIGS. 2, 5 and 6). The fork 34 includes two mutually spaced arms 34*a*, 34*b* which smoothly diverge from each other with increasing distance from the connector 18. At the distal end of the arms 34*a*, 34*b*, the arms gently bend back substantially toward the connector 18, and then integrally interconnect via a U-shaped portion 34*c* to thereby collectively form a yoke 36. The yoke 36 of the fork 34 is dimensioned to receive therein the tongue 30*b* of the collar 30.

A scuff bar 38, preferably constructed of heavy gauge wire, is anchored at the upper edge 16*a*' of the first jaw 16*a*.

Now with additional reference to FIGS. 5 and 6, operation of the adjusting garment hanger will now be detailed.

Figure 2:
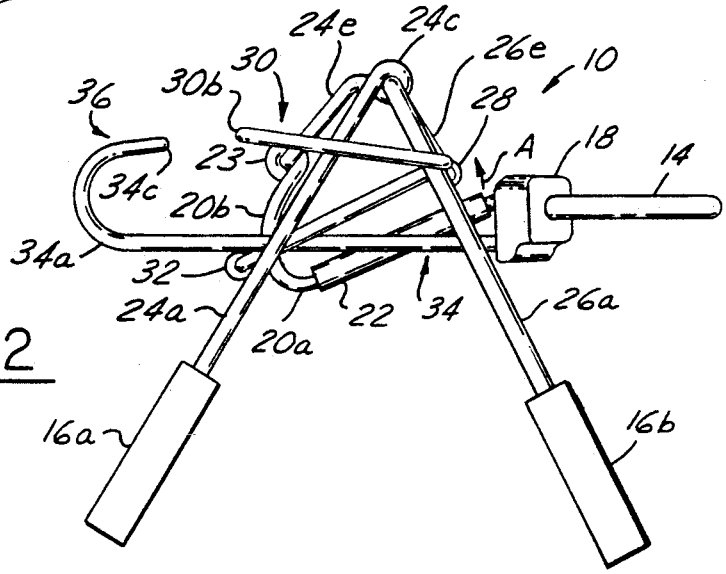
FIG. 2 is an end view of the clamping garment hanger according to the present invention, shown in the maximum open configuration.
Figure 7:
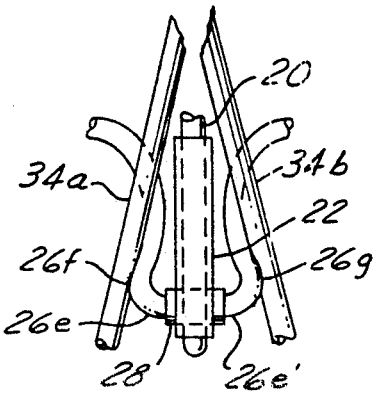
FIG. 7 is a detail rear end view of the clamping garment hanger, showing an interfering lock between the second U-shaped section and the fork.

In operation wherein a standard thickness (defined hereinabove) of garments 12 is placed between the first and second jaws 16*a*, 16*b*, (see FIG. 1) the clamping garment hanger 10 is manipulated from the orientation shown in FIG. 2 to that shown in FIG. 1. The degree of opening (as shown in FIG. 2) of the first and second jaws 16*a*, 16*b* is determined by abutment of the first and second legs of the first and second leg members 24, 26 with the collar 30. The garments are placed between the first and second jaws 16*a*, 16*b*, and the lever 20 rotated along arrow A via the hanger 14. As the lever 20 rotates, the rotating bearing 28 engages the sleeve 22 on the shank portion 20*a* of the lever, and as rotation continues pinching engagement ensues so as to result in clamping force between the first and second jaws 16*a*, 16*b* whereat the rotating bearing 28 has become lockably wedged against the sleeve 22. This structural interrelationship constitutes the primary clamping system. The garment 12 is released by simply moving the lever 20, via the hanger 14, oppositely with regard to arrow A.

In operation wherein a nonstandard thickness (defined hereinabove) of garments 12' is placed between the first and second jaws 16*a*, 16*b*, (see FIG. 5) the clamping garment hanger 10 is manipulated from the orientation shown in FIG. 2 to that shown in FIG. 1. The degree of opening (as shown in FIG. 2) of the first and second jaws 16*a*, 16*b* is again determined by abutment of the first and second legs of the first and second leg members 24, 26 with the collar 30. The garments are placed between the first and second jaws 16*a*, 16*b*, and the lever 20 rotated along arrow A via the hanger 14. As the lever 20 rotates, the roller bearing 28 engages the sleeve 22 on the shank portion 20*a* of the lever, and continued rotation results in pinching engagement therebetween so as to result in clamping force between the first and second jaws 16*a*, 16*b* whereat the rotating bearing has become lockably wedged against the sleeve 22, as recounted hereinabove with respect to the primary clamping system. Simultaneously, the collar 30 floats on the first and second legs of the leg members 24, 26 so as to clampably abut the first leg member with respect to the second leg member while simultaneously the tongue 30*b* of the collar engages abuttingly the yoke 36 of the fork 34 and the roller 32 abuts the scuff bar 38. This structural interrelationship constitutes the secondary clamping system in this example of operation and affords protection against the components of the clamping garment hanger from being oversprung. The garment is released by simply moving the lever 20, via the hanger 14, oppositely with regard to arrow A.

In operation wherein an extraordinary thickness (defined hereinabove) of garments 12" is placed between the first and second jaws 16*a*, 16*b*, (see FIG. 6) the clamping garment hanger 10 is manipulated from the orientation shown in FIG. 2 to that shown in FIG. 1. The degree of opening (as shown in FIG. 2) of the first and second jaws 16*a*, 16*b* is again determined by abutment of the first and second legs of the first and second leg members 24, 26 with the collar 30. The garments are placed between the first and second jaws 16*a*, 16*b*, and the lever 20 rotated along arrow A via the hanger 14. As the lever 20 rotates, the rotating bearing 28 engages the sleeve 22 on the shank portion 20*a* of the lever, and continued rotation results in pinching engagement therebetween so as to result in clamping force between the first and second jaws 16*a*, 16*b*, but the rotating bearing does not become lockably wedged against the sleeve 22, as recounted hereinabove with respect to the primary clamping system. Simultaneously, the collar 30 floats on the first and second legs of the leg members 24, 26 so as to clampably abut the first leg member with respect to the second leg member while simultaneously the tongue 30*b* moves into a position where it no longer abuttingly engages the yoke 36, wherein the roller 32 now abuttingly engages the rear 36*a* of the yoke 36. This structural interrelationship constitutes the secondary locking system in this example of operation and affords protection against the components of the clamping garment hanger from being oversprung and further provides lockage of the mutual clamping of the first and second jaws. As can be understood by reference to FIG. 7, lockage of the mutual clamping of the first and second jaws is provided when the outwardly bent portions 26*f*, 26*g* of the second U-shaped section 26*e* pass between the first and second arms 34*a*, 34*b* of the fork 34 in an interfering snap-fit relationship with respect thereto. The garment 12 is released by simply moving the lever 20, via the hanger 14, oppositely with regard to arrow A.

It is to be understood that the primary clamping system operates when a standard thickness of garments is placed between the first and second jaws and that the secondary clamping system operates supplemental to the primary clamping system when more than a standard thickness of garments is placed between the first and second jaws, in which event the cellar and fork cooperate to prevent the components of the primary clamping system from being oversprung by automatically adjusting to the thickness of the garments. Further in this regard, it is to be understood that when the thickness of the garments placed between the first and second jaws exceeds the nonstandard thickness, then the primary clamping system no longer supplies lockage of the first and second jaws in a mutually clamped relationship; however, such lockage is then supplied by the secondary clamping system. Also, the bearings 28, 32 and the sleeve 22 serve to minimize erosion.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A clamping garment hanger, comprising:

a first jaw;

a second jaw pivotally connected with said first jaw;
a hanger connected with said first and second jaws;
a primary clamping system for clamping said first jaw with respect to said second jaw, said primary clamping system comprising:
a first leg member connected with said first jaw;
a second leg member connected with said second jaw, said second leg member being pivotally connected with said first leg member; and
lever means for pinchably engaging with respect to said first and second leg members so as to clamp said first jaw with respect to said second jaw and for providing lockage of clamping of said first jaw with respect to said second jaw when garments placed between said first and second jaws have a thickness that is less than a first predetermined thickness; and
a secondary clamping system for adjustably clamping said first jaw with respect to said second jaw in association with said primary clamping system, said secondary clamping system comprising:
a collar, comprising:
a left loop;
a right loop spaced from said left loop;
a foot bridging said left loop and said right loop; and
a tongue bridging said left loop and said right loop, said tongue and said foot being vertically mutually spaced;
wherein said collar freely floats with respect to said first and second leg members; and further wherein a first half of said first and second legs are located inside said left loop and a second half of said first and second legs are located inside said right loop; and
a fork, comprising:
a pair of mutually spaced arms, each arm of said pair of arms having a near end and a distal end, each said near end being connected with said lever means, and
a yoke formed between each said distal end;
wherein said yoke is dimensioned to receive said tongue therewithin;
wherein said collar engages abuttably with respect to said second legs and said yoke so as to adjustably supply clamping force to said first and second leg members when garments placed between said first and second jaws have a thickness that exceeds a second predetermined thickness.

2. The clamping garment hanger of claim 1, further comprising a connector connected with said lever means and pivotally connected with each said near end of said pair of arms.

3. The clamping garment hanger of claim 2, further comprising a scuff bar connected with said first jaw; wherein said foot abuttably engages said scuff bar and said tongue abuttably engages said yoke when garments placed between said first and second jaws have a thickness between said first predetermined thickness and said second predetermined thickness.

4. The clamping garment hanger of claim 3, further comprising a roller carried by said foot.

5. The clamping garment hanger of claim 4, wherein said fork is pivotally connected to said connector off-set in relation to said lever means.

6. The clamping garment hanger of claim 2, wherein said yoke has a rear portion, said foot engaging said rear portion of said yoke when garments placed between said first and second jaws have a thickness that exceeds said first predetermined thickness.

7. The clamping garment hanger of claim 6, further comprising lockage means connected with said fork and said second leg member for providing lockage of clamping of said first jaw with respect to said second jaw when garments placed between said first and second jaws have a thickness that exceeds said first predetermined thickness.

8. The clamping garment hanger of claim 7, further comprising a roller carried by said foot.

9. The clamping garment hanger of claim 8, wherein said fork is pivotally connected to said connector off-set in relation to said lever means.

* * * * *